United States Patent [19]

Bowman

[11] 4,310,814

[45] Jan. 12, 1982

[54] TRANSMISSION LINE HYBRID JUNCTION

[75] Inventor: David F. Bowman, Moorestown, N.J.

[73] Assignee: RCA Corporation, New York, N.Y.

[21] Appl. No.: 167,489

[22] Filed: Jul. 11, 1980

[51] Int. Cl.[3] ..... H01P 5/19

[52] U.S. Cl. ..... 333/121; 333/128

[58] Field of Search ..... 333/115, 116, 117, 121, 333/123, 125, 127, 128, 136

[56] References Cited

U.S. PATENT DOCUMENTS

| | | | |
|---|---|---|---|
| 3,089,103 | 5/1963 | Oliner . | |
| 3,091,743 | 5/1963 | Wilkinson . | |
| 3,422,377 | 1/1969 | Vient . | |
| 3,691,485 | 9/1972 | Beck | 333/123 |
| 3,742,392 | 6/1973 | Schwarzmann . | |
| 4,129,839 | 12/1978 | Galani et al. . | |

OTHER PUBLICATIONS

Ekinge, *A New Method of Synthesizing Matched Broadband TEM-Mode Three-Ports,* IEEE Trans. on MTT, vol. MTT-19, No. 1, Jan. 71, pp. 81-88.

*Primary Examiner*—Paul L. Gensler

*Attorney, Agent, or Firm*—Samuel Cohen; Robert L. Troike; Christopher L. Maginniss

[57] ABSTRACT

A transmission line hybrid junction which provides a power dividing and combining function between a first port and a pair of ports. In one embodiment it provides a well-matched, high-isolation, three-port, equal-power, equal-phase, power dividing junction with a bandwidth adequate for typical radio frequency applications. The hybrid junction comprises a single transmission line coupled to a pair of branch transmission lines, and a single resistive element coupled between the branch lines. The single transmission line comprises a quarter wavelength transforming section and each of the branch transmission lines comprises two cascaded quarter wavelength transforming sections. Coupling between two transforming sections of the branch transmission lines permits independent selection of the characteristic impedance of those sections in the odd and even modes of excitation.

13 Claims, 19 Drawing Figures

TRANSMISSION LINE HYBRID JUNCTION

The Government has rights in this invention pursuant to Contract No. DASG60-77-C-0142 awarded by the Department of the Army.

This invention relates to a transmission line hybrid junction and, more particularly, to a well-matched, high-isolation, three-port, equal-power, equal-phase, power dividing junction with a bandwidth adequate for typical radio frequency applications.

A resistive hybrid tee was disclosed by Wilkinson in U.S. Pat. No. 3,091,743, which describes an N-way power divider comprising a coaxial structure in which the inner conductor is split into a plurality of splines of equal width and symmetrically circumferentially distributed, each spline having an equal length of $\lambda/4$ at the nominal operating frequency. U.S. Pat. No. 4,129,839 of Galani et al., discloses a printed transmission line N-way divider on a planar surface, but lacks the matching, isolation and bandwidth required of many radar applications.

Power dividers with resistive elements for dissipating power when operating in the odd mode of excitation are disclosed by Oliner, in U.S. Pat. No. 3,089,103, Vient, in U.S. Pat. No. 3,422,377, and Schwarzmann, in U.S. Pat. No. 3,742,392. Oliner describes a power splitting apparatus including a portion of power absorbing or loss material of determinable length located in the region where the enclosure branches. Vient discloses a power divider comprising a plurality of transforming sections and a plurality of sets of resistive elements between the branched conductors. Schwarzmann discloses an uneven power divider also including distributed resistance located between the branch conductor sections.

Roland B. Ekinge, in the article "A New Method of Synthesizing Matched Broad-Band TEM-mode Three-Ports" in the IEEE Transactions on Microwave Theory and Techniques, Volume MTT-19, No. 1, January 1971, pp. 81–89, describes a three-port hybrid junction consisting of quarter-wave impedance transformers in N-section cascade, having a single resistive element across the branch conductors at each transformer.

In accordance with one embodiment of the present invention a transmission line hybrid junction for transmitting signals within a predetermined RF bandwidth between a single port and a pair of branch ports comprises a single transmission line coupled to the single port, a pair of transmission lines coupled to the branch ports, and a single resistive element coupled between the pair of transmission lines. The single transmission line is a transforming section having electrical length of about one-quarter wavelength, or odd multiple thereof, of a frequency within the predetermined bandwidth. The pair of transmission lines is joined to the single transmission line. Each line of the pair comprises two cascaded transforming sections. Each first transforming section has electrical length of about one-quarter wavelength, or odd multiple thereof, of a frequency within the predetermined bandwidth and each second transforming section also has electrical length of one-quarter wavelength, or odd multiple thereof, of a frequency within the predetermined bandwidth. The second transforming sections are closely coupled uniformly along their length so that their values of characteristic impedance may be independently controlled in the odd and even modes of excitation. The resistive element couples the branch transmission lines at about the point where the two cascaded transforming sections are joined.

Figure 3:
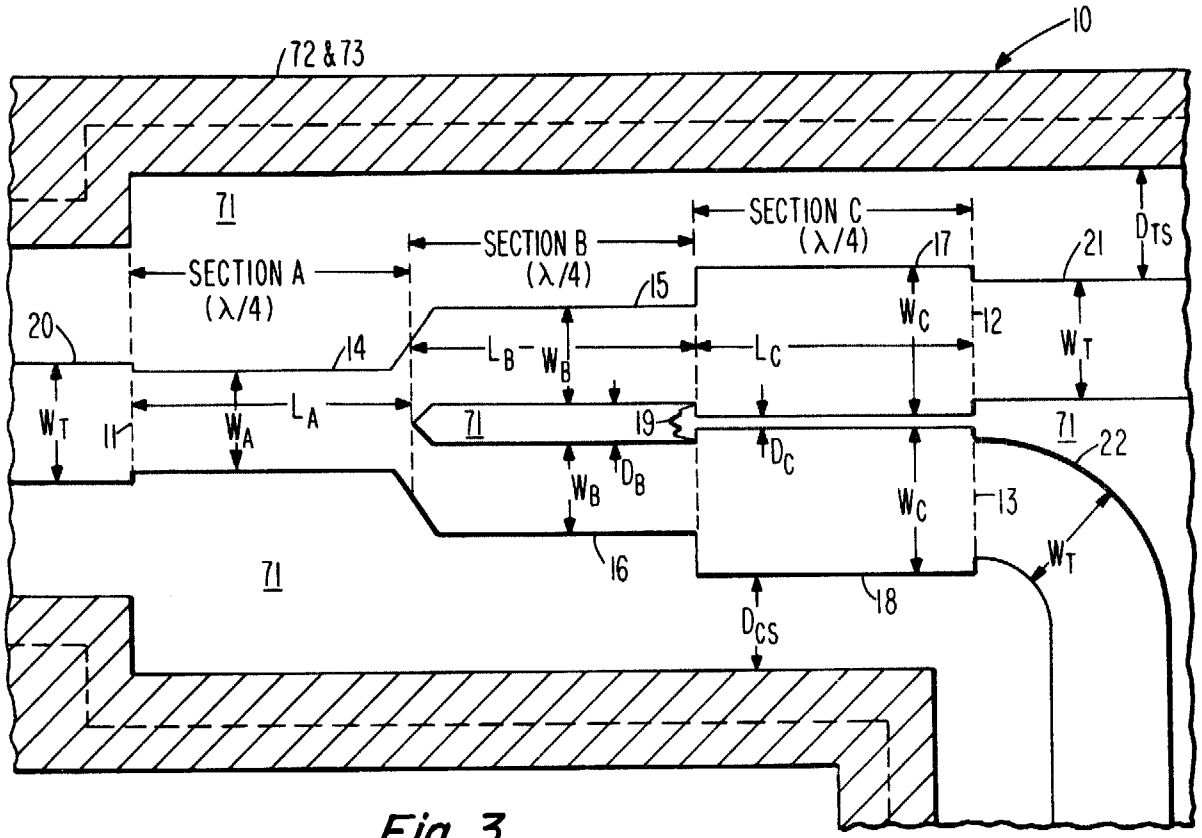
FIG. 3 is a plan view of the preferred embodiment of the instant invention with the horizontal plate of the upper ground plane removed.
Figure 4:
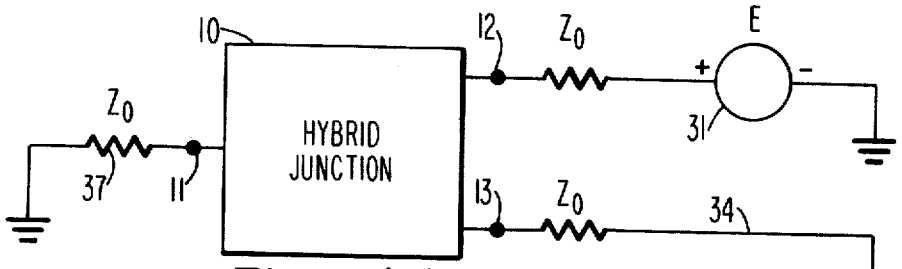
Figure 4:
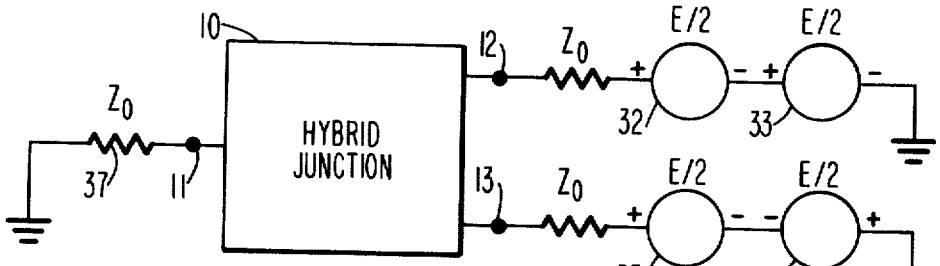
Figure 4:
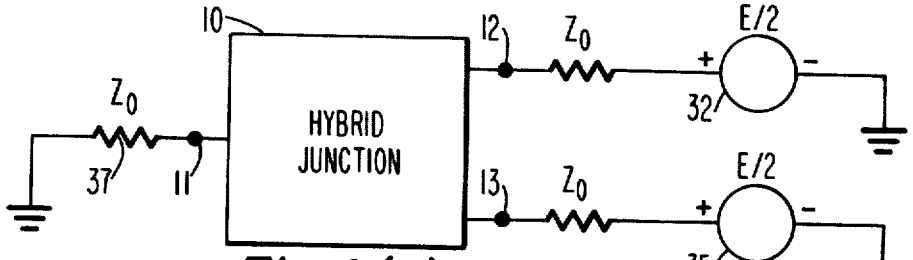
Figure 4:
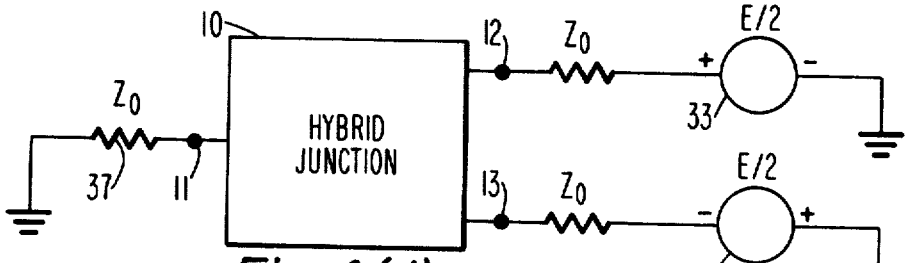
Figure 5:
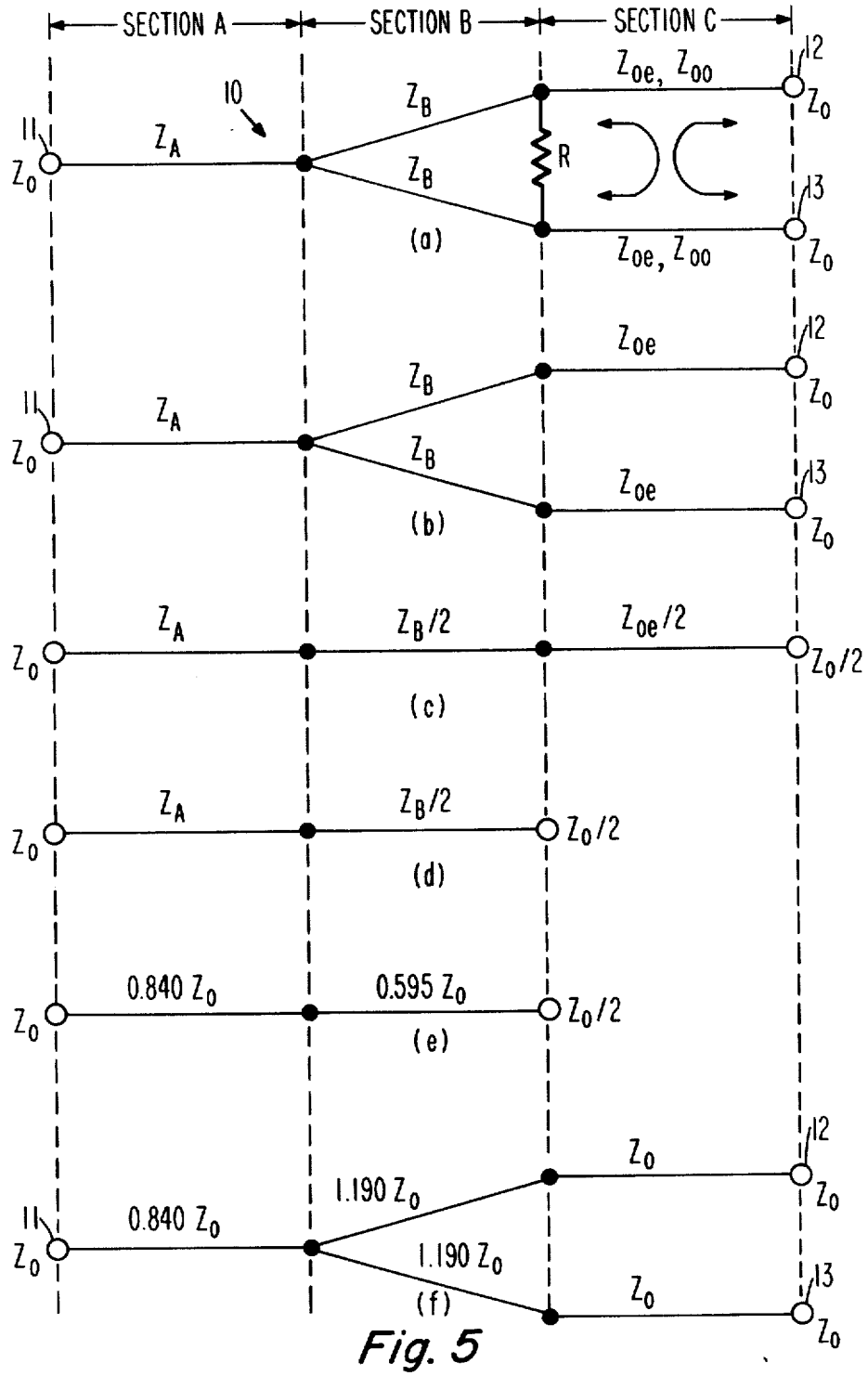
Figure 6:
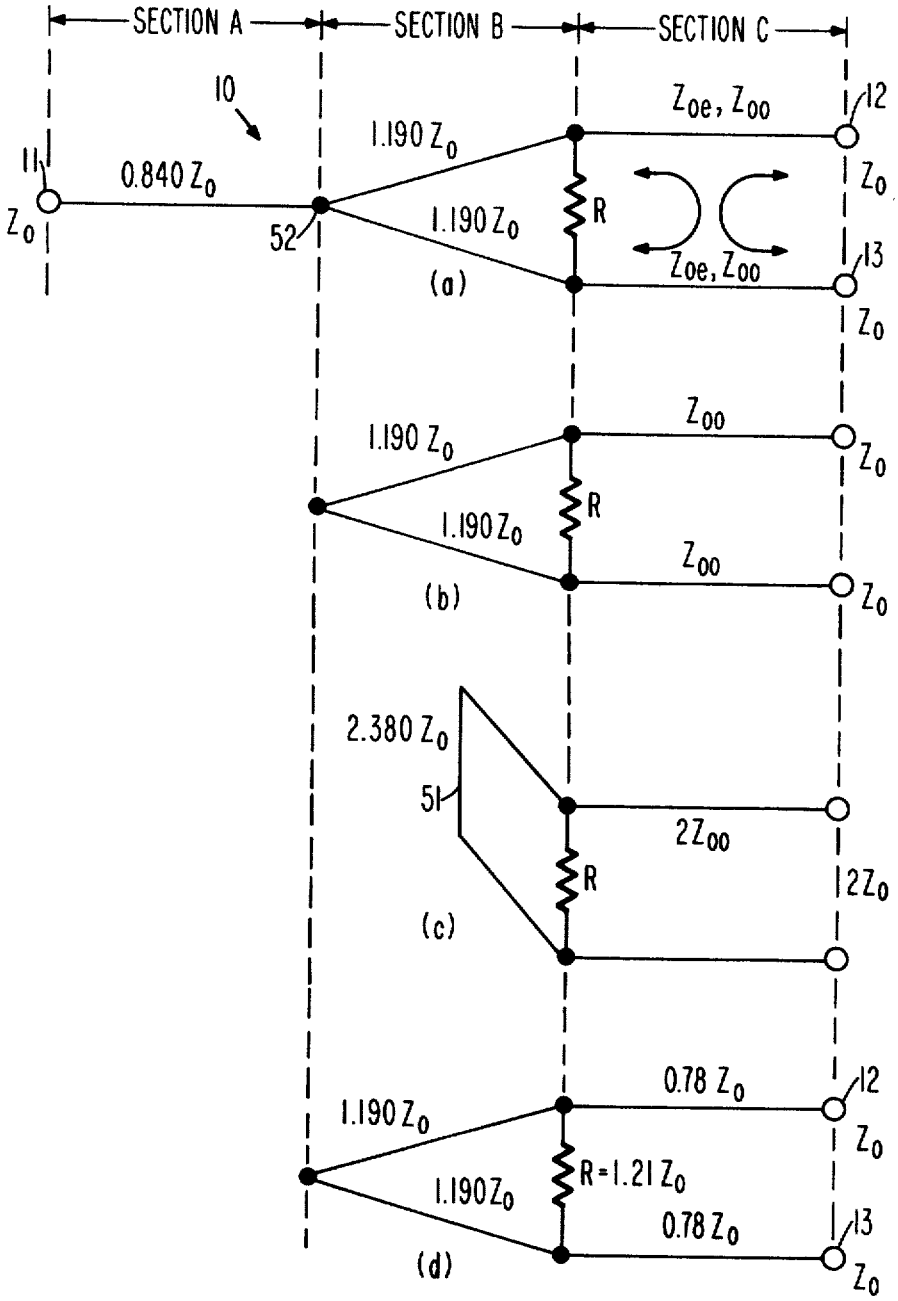
Figure 7:
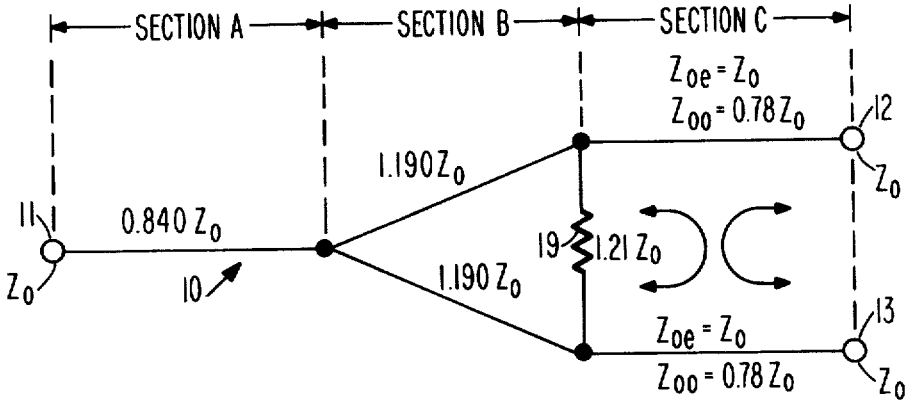
Figure 8:
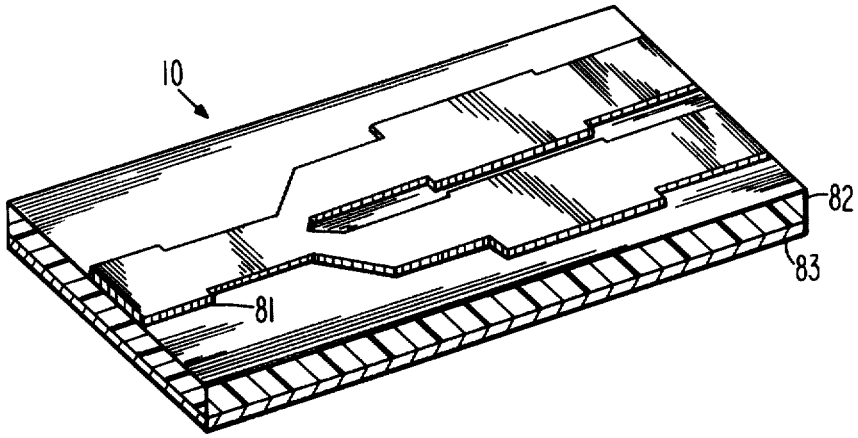

FIGS. 4(*a*) through 4(*d*) are a series of schematic drawings useful in explaining the synthesis of the embodiment of FIG. 3;

FIGS. 5(*a*) through 5(*f*) are a series of schematic drawings useful in explaining the even mode synthesis of the embodiment of FIG. 3;

FIGS. 6(*a*) through 6(*d*) are a series of schematic drawings useful in explaining the odd mode synthesis of the embodiment of FIG. 3;

FIG. 7 is a schematic representation of the embodiment of FIG. 3 including impedance values; and FIG. 8 is a trimetric projection of one embodiment of the instant invention implemented in microstrip.

A four-port hybrid junction is a device that has four pairs of terminals so arranged that a signal entering at one port will divide and emerge from two ports but will be unable to reach the fourth port. A three-port hybrid junction is a hybrid junction in which one of the four pairs of terminals is replaced by a load element within the device.

Figure 1:
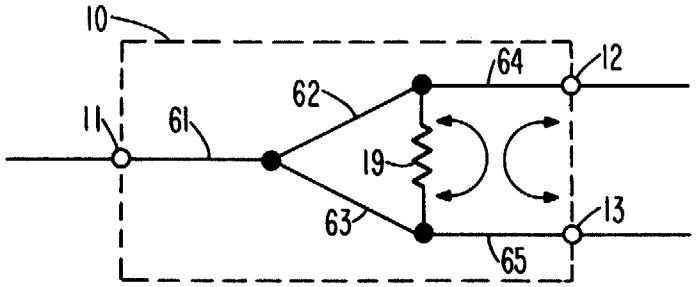
FIG. 1 is a schematic representation of a preferred embodiment of the instant invention.

A single-conductor representation of the hybrid junction is shown in FIG. 1. The second conductor, or ground conductor, is implied but is not shown. The hybrid junction 10 includes a first port 11 on the left and two branch ports 12 and 13 on the right. Wave energy entering the port 11 is equally power divided and applied in-phase to the terminations at the branch ports 12 and 13. Similarly, equal amplitude and in-phase waves entering branch ports 12 and 13 are combined into a single wave which is delivered to the port 11. Wave energy entering branch port 12 (or branch port 13) is generally equally power-divided with nearly equal portions applied to the terminations at port 11 and a resistive load 19 internal to the hybrid junction circuit. The other port, branch port 13 (or branch port 12), is effectively isolated by the hybrid nature of the circuit. However, a very small portion of the wave applied to branch port 12 (or branch port 13) generally does reach the isolated branch port. The maximum amplitude of this portion relative to the input wave will be determined in a later discussion.

The representative of FIG. 1 shows hybrid junction 10 as comprising a single conductor 61 connected to port 11, a pair of conductors 62 and 63 branching from conductor 61, and a second pair of conductors 64 and 65, connected to conductors 62 and 63, respectively, having coupling between them. Resistor 19 is connected from the junction of conductors 62 and 64 to the junction of conductors 63 and 65. With the proper selection of (a) characteristic impedances of the several transforming sections comprising the conductors 61 through 65 and their second conductors (not shown), (b) the value of resistor 19, and (c) selection of the coupling between conductors 64 and 65, hybrid junction 10 can be designed to embody those characteristics of a hybrid junction defined above.

Figure 2:
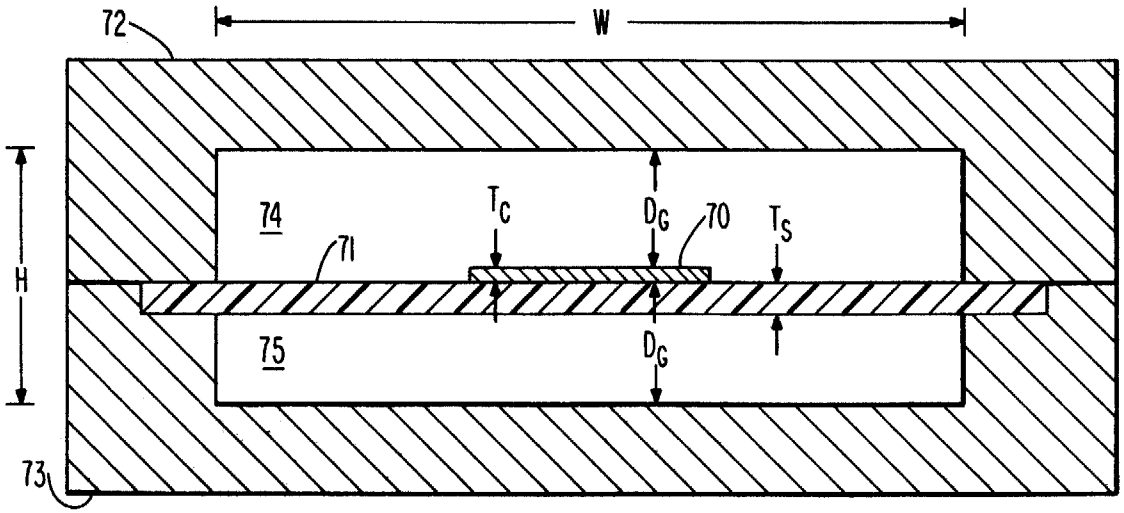
FIG. 2 is a cross-sectional view of suspended substrate transmission line of the type employed in the preferred embodiment.

The present embodiment is executed in suspended-substrate transmission line, an instance of which is depicted in cross-sectional view of FIG. 2. The first conductor 70 is a narrow conducting strip bonded to one side of a dielectric substrate 71. The substrate 71 may be, for example, a Teflon-fiberglass laminate having a permittivity of $\epsilon=3.15$. The second conductor or ground plane comprises two conductive blocks 72 and 73 which, in the present embodiment, are made of aluminum, which support substrate 71 and which maintain the position of the narrow strip conductor 70 within channels 74 and 75 in the conductive blocks 72 and 73, respectively. Air forms the balance of the dielectric material within channels 74 and 75. The permittivity of air is $\epsilon=1.0$.

In this embodiment the characteristic impedance of each section of the transmission line is determined, for the most part, by the field interaction of the narrow strip conductor 70 with the upper and lower surfaces of the ground conductors 72 nd 73. The effect on the characteristic impedance of the interaction between the narrow strip conductor 70 and the side walls of the channels 74 and 75 within conductive blocks 72 and 73 is small but measurable, and must be considered when the transmission lines are implemented.

The applicant has chosen suspended-substrate for his embodiment, but the principles to be taught herein are equally applicable to other types of transmission line. Among the other types are coaxial cable, in which concentric cylindrical conductors are spaced by a dielectric material; microstrip, in which two strip conductors are bonded to opposite sides of a dielectric substrate; strip transmission line, in which the first conductor is sandwiched between strips of the ground conductor but spaced from them by layers of dielectric material; and suspended strip, in which the first conductor is a narrow strip conductor suspended within a second conductor, with air as the only dielectric material. Any arrangement of transmission line conductors capable of transmitting energy in the transverse electromagnetic (TEM) mode may be applied to this invention.

FIG. 3 is a plan view of the layout of the narrow strip conductors of a suspended-substrate transmission line version of the hybrid junction 10 according to the preferred embodiment of the instant invention, showing the general relationship of the component parts. The view of FIG. 3 is that which would be obtained by looking down on FIG. 2 with the top plate of conductive block 72 removed. The narrow strip conductors 14 through 18 and 20 through 22 are bonded to the dielectric substrate 71. The substrate 71 is suspended between conductive blocks 72 and 73 (the latter is shown in FIG. 2). The narrow strip conductors 14 through 18 and 20 through 22 comprise the first conductors and the ground conductors 72 and 73 comprise the second conductors of the transmission lines and the hybrid junction 10. No attempt is made to represent FIG. 2 or FIG. 3 as proportionally accurate characterizations of the geometrical relationships of the several transforming sections within the hybrid junction 10. The circuit between the port 11, shown in FIG. 3 as the discontinuity between narrow strip conductors 14 and 20, and branch ports 12 and 13, shown in FIG. 3 as the discontinuities between strip conductors 17 and 21 and strip conductors 18 and 22, respectively, includes three transforming sections A, B and C of transmission line and a resistive element 19. Section A, the portion of hybrid junction 10 between the port 11 and Section B, includes narrow strip conductor 14 which, in combination with ground conductors 72 and 73, forms a transmission line transforming section having an electrical length of one-quarter wavelength at, for example, a frequency within the X-band, or 10 GHz. Section B, the portion of hybrid junction 10 between Sections A and C, includes narrow strip conductors 15 and 16 which, in combination with ground conductors 72 and 73, form transforming sections each having approximately the same electrical length as Section A above. Section C, the portion of hybrid junction 10 between Section B and branch ports 12 and 13, includes strip conductors 17 and 18 which, in combination with ground conductors 72 and 73, form transforming sections each having approximately the same electrical length as Sections A and B above. The strip conductors 17 and 18 of Section C are closely spaced from each other so that they are effectually coupled uniformly along their length. The spacing $D_C$ between strip conductors 17 and 18 is sufficiently small to provide a close coupling between them. The larger spacing $D_B$ between strip conductors 15 and 16 provides no discernible coupling between them.

Resistive element 19 is coupled between the branch portions of hybrid junction 10 and is located between narrow strip conductors 17 and 18 at the juncture of Sections B and C. Conductors 20, 21 and 22, to which hybrid junction 10 is coupled at ports 11, 12 and 13, respectively, comprise with the ground conductors 72 and 73 transmission lines having, in the present embodiment, equal characteristic impedances of, for example, 50 ohms. The configuration of narrow strip conductors 21 and 22, as depicted in FIG. 3, is such as to ensure that no coupling exists between them.

From the configuration defined above, the applicant has, by selecting the values of characteristic impedances of the conductors in the three sections and the value of the junction resistor, and by varying the physical configuration of the conductors in Section C so as to provide the desired coupling, produced a hybrid junction that matches a first port impedance to two equal branch port terminating impedances and which provides equal-amplitude, in-phase coupling to the branch ports from the first port with a high degree of isolation between the branch ports. In addition, using the parameters of characteristic impedances and coupling, the applicant notes three variations of the basic design which are a manifest result of the structure described. In a first variation, a hybrid junction may be provided in which the impedance level at the first port is unequal to the impedance levels at the branch ports. In a second variation, the impedance levels at the two branch ports may be unequal resulting in unequal power coupling to those ports. The third variation may provide unequal power coupling to branch ports having equal terminating impedances.

The characteristic impedance $Z_o$ of a transmission line of the type shown in FIGS. 2 and 3 is influenced by several factors, including the width of the first conductor, the distance between the first and second conductors, the type and arrangement of the dielectric material between the conductors, and, in the present embodiment, the distance between the first conductors and the side walls of the second conductors. These factors generally also affect the characteristic impedance of other types of transmission lines including coaxial cable, microstrip, strip transmission line, or suspended strip conductors. Thus, the applicant may select values of $Z_o$ for the several transforming sections by varying the above parameters, most notably the width of the first conductor.

The operation of the hybrid junction 10 can best be analyzed as a superposition of odd and even modes. FIG. 4(*a*) depicts the hybrid junction 10 with an excitation voltage source 31 having value E applied to the upper of the two branch conductors. The circuit of FIG. 4(*b*) is equivalent to the FIG. 4(*a*) circuit but expanded such that the voltage source 31 has been separated into two equal-amplitude, in-phase sources 32 and 33, and the zero voltage on the lower branch 34 (in FIG. 4(*a*)), has been divided into two voltage sources 35 and 36 having value of E/2 but in opposite directions, thus satisfying the net zero voltage condition. By the principle of superposition, the excitation voltages applied to hybrid junction 10 as shown in FIG. 4(*b*) can be separately applied to that circuit and the individual responses combined. Consequently, the circuits of FIG. 4(*c*) and FIG. 4(*d*) are presented for analysis as the equivalent of the circuit of FIG. 4(*a*). The circuit of FIG. 4(*c*) is the even mode of excitation, and the circuit of FIG. 4(*d*) is the odd mode of excitation.

When an even mode excitation is applied to transmission line conductors which are coupled uniformly, as are the strip conductors 17 and 18 of Section C of hybrid junction 10, the transmission line assumes an even mode value of characteristic impedance $Z_{oe}$. In the presence of odd mode excitation, the transmission line assumes an odd mode value of characteristic impedance $Z_{oo}$. The treatment of the relations among even and odd mode impedances and the coupling is presented in Section 13.07 on pages 802–805 of *Microwave Filters, Impedance-Matching Networks, and Coupling Structures* by George L. Matthaei, Leo Young, and E. M. T. Jones, published by McGraw-Hill Book Company of New York, N.Y., in 1964. A discussion of the physical dimensions necessary to give the required even and odd mode impedances $Z_{oe}$ and $Z_{oo}$ can be found in Section 5.05 on pages 174–197 of that same reference. The factors contributing to the impedance levels include the dimensions of the cross-section of the conductors, the spacing between the conductors, and the relative permittivities of the dielectric substances surrounding the conductors, for example, the dielectric constants of air and of substrate 71 as shown in FIG. 2.

In the even mode the present embodiment performs as a three-port hybrid junction, matching a generator connected to the port 11 to two in-phase loads connected to the branch ports 12 and 13. By symmetry, the even mode may also be considered as matching a load connected to the port 11 to two in-phase generators connected to branch ports 12 and 13. In this embodiment, the characteristic impedances of the loads and generators are equal and designated as $Z_o$, but this equality is not a restriction which is essential to the operation of the invention.

Referring to FIG. 5(*a*), the hybrid junction 10 is shown in schematic form with lines representing the transforming sections. The characteristic impedance of the transmission line of Section A is designated $Z_A$, the characteristic impedances of the transmission lines of Section B are designated $Z_B$, and the even mode characteristic impedances of the transmission lines of Section C are designated $Z_{oe}$. For reasons of symmetry, it can be easily seen that no voltage will appear across resistor R in response to a generator at the port 11 and in-phase loads at the branch ports 12 and 13 (or in-phase generators at the branch ports 12 and 13 and a load at the port 11), resulting in the circuit of FIG. 5(*b*).

The upper and lower lines of Sections B and C as shown in FIG. 5(*b*) may be merged into the single lines of the simplified equivalent circuit of FIG. 5(*c*), with the impedance levels halved as a result. Because the coupling between the conductors of Section C provides independent control of the odd and even mode impedances, $Z_{oe}$ can be selected to be equal to $Z_o$, the impedance at the branch ports 12 and 13, and the even mode equivalent circuit is further reduced to the representation shown in FIG. 5(*d*).

This circuit may now be synthesized as a two-section Tchebyscheff transformer. For a given maximum allowable reflection coefficient $\rho_m$, the use of a Tchebyscheff transformer provides an optimum design in which the reflection coefficient cycles between zero and $\rho_m$ within the frequency band but increases sharply outside the band. Synthesis of a Tchebyscheff transformer is described by the present application in Section 31 of the *Antenna Engineering Handbook*, edited by Henry Jasik and published by McGraw-Hill Book Company, New York, N.Y., in 1961, and incorporated herewith by reference.

It should be noted that synthesis using a Tchenbyscheff transformer is not an exclusive method. Whereas a binomial transformer, a member of the set of Tchebyscheff transformers, may also be employed, it is felt that the wider frequency band of the Tchebyscheff transformer provides more useful results.

The impedance of each section of an N-section Tchebyscheff transformer can be computed in terms of the transformation ratio $R_2/R_1$ ($Z_o/0.5Z_o=2$ in the present case) and the frequency coefficient F, related to the bandwidth. Operating over a frequency band of $0.9394f_o$ to $1.0606f_o$, a bandwidth of 12.9 percent, where $f_o$ is a frequency within the X-band, the frequency coefficient F is determined according to $$F = \frac{f_+/f_- - 1}{f_+/f_- + 1} = 0.0606,$$

where $f_+$ and $f_-$ are, respectively, the highest and lowest frequencies within the bandwidth. For a two-section Tchebyscheff transformer, the design ratio is given by $$\frac{\log(R_2/R_1)}{\log(Z_1/R_1)} = \frac{\log(R_2/R_1)}{\log(R_2/Z_2)} = 4 - 2\cos^2\theta_-$$

where $$\theta_- = \frac{(1-F)\pi}{2} \text{ radians,}$$

$R_2/R_1$ is the transformation ratio ($R_2 > R_1$), $Z_1$ is the impedance of the section adjacent to the terminating impedance $R_1$, and $Z_2$ is the impedance of the section adjacent to the terminating impedance $R_2$.

For the circuit and parameters of the present embodiment, the design ratio of 3.982 is obtained, resulting in transforming section impedances of $0.595Z_o$ and $0.840Z_o$ as shown in FIG. 5(*e*). Relating these values back into FIG. 5(*b*), the even mode equivalent circuit with values of transforming section impedances is shown in FIG. 5(*f*).

FIG. 31-14 on page 31-15 of the above-mentioned reference, edited by Jasik, provides a graph for determining the performance of a Tchebyscheff transformer. For a frequency coefficient F=0.0606, and a transformation ratio $R_2R_1=2$, the maximum in-band even mode reflection coefficient of a two-section transformer is given as $\rho_{em}=0.0016$.

Referring now to FIG. 6(*a*), the hybrid junction 10 is shown in schematic form with lines representing the transforming sections and assuming the impedances determined by the even mode synthesis. Because of symmetry considerations, it can be easily seen that the voltage level at the juncture 52 of Section A and Section B, upon application of the odd mode excitation of equal but out-of-phase voltages at the branch ports 12 and 13, as shown in FIG. 4(*d*), is zero volts. As a result, no current will flow from that juncture 52 through the load 37 (shown in FIG. 4(*d*) connected to the port 11. The equivalent circuit is thereby reduced to that depicted in FIG. 6(*b*). The upper and lower lines of FIG. 6(*b*) may be merged into single lines of the two conductor type as shown in the simplified circuit of FIG. 6(*c*). Impedance levels of the lines and the balanced terminating impedance are doubled as a result. The odd mode circuit is thereby reduced to a quarter wavelength transformer (Section C) shunted by a quarter wavelength stub 51 on the left, and connected between R on the left and $2Z_o$ on the right.

Referring to Section 31.5, "Combinations of Transformers and Stubs," on pages 31-20 through 31-22 of the above-mentioned reference, the applicant has employed the following relationships in determining the value of the resistor R, the odd mode impedance of the coupled transforming section $Z_{oo}$, and the maximum odd mode reflection coefficient $\rho_{om}$:

$$Z_1 = \sqrt{R_1R_2/S_m} \quad R_2 > R_1 \text{ (typographical error in reference corrected)}$$

$$Z_2 = Z_1 \Big/ \frac{R_2}{S_mR_1} - 1$$

$$\cos[\pi(1-F)] = \frac{2S_m - \frac{R_2}{R_1} - \frac{1}{S_m}}{\frac{R_2}{R_1} - \frac{1}{S_m}}$$

where $Z_1$ is the impedance of the shunt stub, $Z_2$ is the impedance of the quarter wavelength section, $R_1$ and $R_2$ are the terminating resistances, and $S_m$ is the maximum standing wave ratio and is related to $\rho_m$ by $$S_m = \frac{1+\rho_m}{1-\rho_m}.$$

Care in the selection of values of R and $Z_{oo}$ will result in a minimum value of the odd mode reflection coefficient $\rho_{om}$, which is directly related to the odd mode performance of the hybrid junction over the specified bandwidth. Signal isolation between the branch ports 12 and 13 is increased as the combined odd and even mode maximum reflection coefficient is reduced.

Using the relations above, the graph in FIG. 31-22 on page 31-21 of the above-mentioned reference, *Antenna Engineering Handbook*, and the values determined for the even mode synthesis, the applicant has obtained the following odd mode results, which are depicted in the circuit of FIG. 6(*d*):

$Z_{oo}=0.78Z_o$ $R=1.21Z_o$, and $\rho_{om}=0.0015$.

FIG. 7 is a representation of the hybrid junction of the present embodiment, including its impedance levels achieved by odd mode and even mode synthesis. RF energy entering the port 11 is delivered in equal amplitude in-phase portions to the terminations at branch ports 12 and 13. Similarly, equal amplitude and in-phase RF energy entering branch ports 12 and 13 are combined into a single signal to the termination at port 11. RF energy entering branch port 12 (or branch port 13) is applied to the termination at the port 11 and to the resistor 19 in nearly equal portions. The other branch port 13 (or branch port 12) is effectively isolated by the hybrid nature of the circuit.

A small portion of the RF energy generally does reach the isolated branch port. The amplitude of that portion relative to the input signal is half the vector difference between the even and odd mode reflection coefficients. Thus, it cannot exceed the arithmetic means of the even and odd reflection coefficient magnitudes. In the present embodiment, having a maximum even mode reflection coefficient $\rho_{em}$ of 0.0016 and a maximum odd mode reflection coefficient $\rho_{om}$ of 0.0015, the leakage energy to the isolated branch port, relative to the input signal, cannot exceed 0.00155, a minimum isolation of 56 db.

Relating the values of characteristic impedance of the transforming sections of hybrid junction 10 obtained in the above synthesis procedure to the physical dimensions indicated in FIGS. 2 and 3, the applicant assigns the following values to provide a clearer understanding:

W, the width of the channel 74 (or 75) in conductive block 72 (or 73), as shown in FIG. 2, = 5.08 mm;

H, the distance between the upper and lower channel surfaces of conductive blocks 72 and 73, = 2.54 mm;

$T_S$, the thickness of substrate 71, = 0.20 mm;

$T_C$, the thickness of narrow strip conductor 70, = (approx.) 0.04 mm;

$D_G$, the distance between narrow strip conductor 70 and the ground conductors 72 and 73, = 1.17 mm;

$L_A$, the length of narrow strip conductor 14 in Section A, as shown in FIG. 3, = 4.01 mm;

$W_A$, the width of narrow strip conductor 14 in Section A, = 1.39 mm;

$L_B$, the length of narrow strip conductors 15 and 16 in Section B, = 4.01 mm;

$W_B$, the width of narrow strip conductors 15 and 16 in Section B, = 1.35 mm;

$L_C$, the length of strip conductors 17 and 18 in Section C, = 3.87 mm;

$W_C$, the width of strip conductors 17 and 18 in Section C, = 2.11 mm;

$W_T$, the width of narrow strip conductors 20, 21 and 22, = 1.69 mm;

$D_B$, the space between narrow strip conductors 15 and 16 in Section B, = 0.57 mm;

$D_C$, the space between closely coupled strip conductors 17 and 18 in Section C = 0.18 mm;

$D_{CS}$, the distance between strip conductors 17 and 18 and the sidewall of conductive block 72, = 1.40 mm; and $D_{TS}$, the distance between narrow strip conductors 20, 21 and 22 and the sidewall of conductive block 72, = 1.65 mm.

The values given above are for purposes of illustration only and do not limit the invention in that regard.

Whereas the combined even and odd mode reflection coefficient calculated earlier represents a maximum, a substantially smaller reflection coefficient, and hence higher isolation, results when the velocities of the waves traveling through the coupled section are nearly the same under even and odd mode excitation. The reflection coefficients of the even and odd modes at a plane through branch ports 12 and 13 present loci in the reflection coefficient plane with varying frequency that are inherently similar in size, shape and placement. Careful selection of circuit values can enhance the degree of similarity so that half the vector difference is smaller than the arithmetic mean by at least one order of magnitude. The resulting improvement in minimum isolation is at least 20 db.

One advantage of the embodiment shown in FIG. 2 including the conductive blocks 72 and 73 as ground conductors is the ease of providing a further means of controlling the characteristic impedance of the transforming sections. Whereas in most realizations the only reasonable means of varying the characteristic impedance is by changing the width of the first conductor, a cast aluminum or white metal block having channel portions of differing depths may provide an economic means for varying the characteristic impedance by changing the distances between the first and second conductors.

Referring again to FIG. 2, the presence of the dielectric substrate 71 supporting the narrow strip conductor 70 creates a nonhomogeneity in the permittivity over the cross-section of the line. One result of this nonhomogeneity affecting the hybrid junction 10 of FIG. 3 is a difference in wave velocities of the odd and even mode signals in the coupled branch lines of Section C. Good design practice is to select the lengths of the Section C conductors to be midband quarter wavelength in the odd mode. The fact that the Section C conductors differ from a midband quarter wavelength in the even mode does not affect the magnitude of the even mode reflection coefficient as the even mode characteristic impedance $Z_{oe}$ is selected, by dimensional determination, to be equal to the terminating impedance $Z_o$. This adaptability of unequal wave velocities is an important feature of the instant invention. If substantial differences in the even and odd mode electrical lengths occur, the corresponding loci of mode reflection coefficients become substantially different in shape and position as viewed in the complex reflection coefficient plane. As a result the values of minimum isolation attained over the operating frequency band may not be as high as with equal lengths, but are nevertheless appropriate for demanding applications.

It was stated earlier, in reference to FIG. 3, that spacing $D_B$ is sufficiently large that no discernible coupling exists between strip conductors 15 and 16 of Section B. That condition, however, is not essential to the operation of the instant invention as a hybrid junction. If there were appreciable coupling between strip conductors 15 and 16, such that the characteristic impedances of the transforming sections of Section B were measurably different in the even and odd modes of excitation, the principles taught herein would still apply. In the even mode synthesis the even mode characteristic impedance of Section B would be employed in the two-section Tchebyscheff transformer, and the odd mode characteristic impedance would determine the impedance of the shunt stub in the odd mode synthesis. This adaptability of the instant invention, to operate with or without discernible coupling between the conductors 15 and 16 of Section B, provides a degree of freedom to the designer in the layout of the hybrid junction.

In FIG. 8 a trimetric projection of a microstrip realization of the present invention is shown. The narrow strip conductors 14 through 18 and 20 through 22 (as depicted in FIG. 3), comprising the hybrid junction 10 and the adjacent transmission lines, are implemented on the thin conductive sheet 81 bonded to one surface of dielectric substrate 82. The second, or ground, conductor of the transmission line is a second thin conductive sheet 83 bonded to the other surface of the dielectric substrate 82.

Although the preferred embodiment described above deals with a hybrid junction which operates between a first transmission line and a pair of branch transmission lines having equal terminating impedance levels, and which couples equal amounts of power to the branch lines from the first transmission line, the invention is not limited by those restrictions, and three variations are noted which employ basically the same structure and principles, but which provide a great deal of operational flexibility for special applications.

In a first such variation the characteristic impedances of the transforming sections of the hybrid junction may be proportioned for operation between a single transmission line and pair of branched transmission lines of equal terminating impedances, but which are not equal to the terminating impedance of the single transmission line. By applying the even mode and odd mode syntheses to the values of the branch port characteristic impedance, a new set of characteristic impedance values and degree of coupling for the transforming sections may be obtained by re-calculation, and substantially the same high isolation, equal-amplitude, in-phase hybrid junction performance is maintained.

The second variation involves unequal resistive terminating impedances at the branch ports, resulting in unequal coupling of power to those ports. The power coupling ratio at each port will be inversely proportional to the terminating impedance at that port. This variation is configured by providing impedance values for the transforming sections of Sections B and C different from those indicated in FIG. 7 although the circuit operation is fundamentally the same. This variation involves a compromise of performance and the degree of isolation is adversely affected as the difference in the impedances of the branch ports increases. For small differences in impedance, the performance degradation is slight.

In the third variation unequal power coupling to the two branch ports having equal terminating impedances is effected. This is done by changing the even mode impedances of the Section C transforming sections from the values shown in FIG. 5(*f*). The impedance level of one line is increased and the other decreased by altering the conductor widths or by changing the distance between the first conductors and the ground planes. This requires an adjustment of the impedance levels of the Section B conductors, and consequently an adjustment of the odd mode impedance levels of the Section C transforming sections. As in the second variation, this variation involves a compromise and if the inequality of the coupling is not great, the performance of the hybrid junction is not significantly impaired with regard to impedance matching and isolation.

What is claimed is:

1. A transmission line hybrid junction for transmitting RF signals having frequency within a predetermined bandwidth between a first port and a pair of ports comprising:

a first transmission line coupled to said first port and a pair of branch transmission lines coupled to said pair of ports;

said first transmission line including a first transforming section having electrical length of approximately one-quarter wavelength or odd multiple thereof of an operating frequency within said predetermined bandwidth, and joined to said pair of branch transmission lines each having a first section joined to a second section, wherein said first sections include transforming sections having electrical length of approximately one-quarter wavelength or odd multiple thereof of an operating frequency within said predetermined bandwidth, and said second sections include transforming sections having electrical length of approximately one-quarter wavelength or odd multiple thereof of an operating frequency within said predetermined bandwidth and said second sections of said pair of branch transmission lines closely coupled uniformly along their length to provide independent control of their values of characteristic impedance in the odd and even modes of excitation; and a resistance element coupled between said pair of branch transmission lines at the approximate junction of said first and second sections.

2. The transmission line hybrid junction of claim 1 wherein the dimensions affecting the characteristic impedances of said first transmission line and said pair of branch transmission lines are such as to form a Tchebyscheff transformer in the even mode of excitation.

3. The transmission line hybrid junction of claim 1 wherein the even mode characteristic impedances of said second sections of said pair of branch transmission lines are equal to the characteristic impedances at the corresponding pair of ports.

4. The transmission line hybrid junction of claim 3 wherein the dimensions affecting the characteristic impedances of said first transmission line and said first sections of said pair of branch transmission lines are such as to form a two-section Tchebyscheff transformer.

5. The transmission line hybrid junction of claim 1 wherein the combination of said pair of branch transmission lines and said resistance element comprises a transforming section with a shunt stub in the odd mode of excitation.

6. The transmission line hybrid junction of claim 5 wherein the characteristic impedance of said shunt stub is determined by the characteristic impedances of said first sections of said pair of branch transmission lines.

7. The transmission line hybrid junction of claim 1 wherein said first sections of said pair of branch transmission lines are coupled along their length to provide independent control of their values of characteristic impedance in the odd and even modes of excitation.

8. The transmission line hybrid junction of claim 1 wherein said first transmission line and said pair of transmission lines transmit energy in the transverse electromagnetic TEM mode.

9. The transmission line hybrid junction of claim 1 wherein said first transmission line and said pair of transmission lines are of the type including a first conductor enclosed within and spaced from a second conductor.

10. The transmission line hybrid junction of claim 9 wherein said first conductor is a narrow strip-like conductor suspended within said second conductor.

11. The transmission line hybrid junction of claim 10 wherein said narrow strip-like conductor is bonded to a dielectric substrate.

12. The transmission line hybrid junction of claim 1 wherein said first transmission line and said pair of transmission lines are implemented on microstrip.

13. The transmission line hybrid junction of claim 1 wherein said electrical lengths of said second sections of said pair of branch transmission lines are determined in the odd mode of excitation.

* * * * *